US007304433B2

(12) United States Patent
Hur et al.

(10) Patent No.: US 7,304,433 B2
(45) Date of Patent: Dec. 4, 2007

(54) PLASMA DISPLAY PANEL

(75) Inventors: Min Hur, Suwon-si (KR); Hoon-Young Choi, Suwon-si (KR); Young-Do Choi, Suwon-si (KR); Takahisa Mizuta, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 21 days.

(21) Appl. No.: 11/274,349

(22) Filed: Nov. 16, 2005

(65) Prior Publication Data

US 2006/0103312 A1 May 18, 2006

(30) Foreign Application Priority Data

Nov. 17, 2004 (KR) ..... 10-2004-0093921

(51) Int. Cl.
*H01J 17/49* (2006.01)

(52) U.S. Cl. ..... 313/585; 313/582; 313/584

(58) Field of Classification Search ..... 313/582–587
See application file for complete search history.

(56) References Cited

U.S. PATENT DOCUMENTS

| | | | | |
|---|---|---|---|---|
| 5,939,826 | A * | 8/1999 | Ohsawa et al. | 313/582 |
| 6,411,033 | B1 * | 6/2002 | Mori et al. | 313/582 |
| 6,650,062 | B2 * | 11/2003 | Inoue et al. | 315/169.3 |
| 6,833,673 | B2 * | 12/2004 | Toyoda et al. | 313/583 |
| 7,088,314 | B2 * | 8/2006 | Harada et al. | 345/60 |
| 2003/0173899 | A1 * | 9/2003 | Toyoda et al. | 313/583 |
| 2003/0227427 | A1 * | 12/2003 | Kim | 345/60 |
| 2004/0164679 | A1 * | 8/2004 | Hibino et al. | 313/582 |
| 2005/0062422 | A1 * | 3/2005 | Sasaki et al. | 313/587 |
| 2005/0242730 | A1 * | 11/2005 | Mizuta | 313/586 |
| 2005/0264195 | A1 * | 12/2005 | Choi et al. | 313/582 |
| 2006/0082303 | A1 * | 4/2006 | Song | 313/582 |
| 2006/0087235 | A1 * | 4/2006 | Kang | 313/582 |
| 2006/0103308 | A1 * | 5/2006 | Kweon | 313/582 |
| 2006/0113910 | A1 * | 6/2006 | Kang et al. | 313/583 |
| 2006/0267499 | A1 * | 11/2006 | Yoo et al. | 313/582 |

FOREIGN PATENT DOCUMENTS

| | | | |
|---|---|---|---|
| JP | 2001-307642 | A1 | 11/2001 |
| JP | 2003-151449 | A1 | 5/2003 |
| WO | WO0005740 | A1 | 2/2000 |

* cited by examiner

*Primary Examiner*—Mariceli Santiago
*Assistant Examiner*—José M Diaz
(74) *Attorney, Agent, or Firm*—H.C. Park & Associates, PLC

(57) ABSTRACT

The invention provides a plasma display panel having an opposed discharge configuration that can improve luminous efficiency while reducing a discharge firing voltage. The PDP may include a first substrate separated from an opposing second substrate by a predetermined interval. A plurality of discharge cells may be defined between the substrates within this interval. Address electrodes having protrusions that protrude toward the inside of each discharge cell may extend on the first substrate along a first direction. First electrodes may be arranged on both sides of the discharge cell along a second direction crossing the first direction and may be spaced from the address electrode between the first substrate and the second substrate. Second electrodes arranged between and substantially parallel the first electrodes may pass through each discharge cell. The first and second electrodes may project away from the first substrate and in a direction toward the second substrate.

29 Claims, 16 Drawing Sheets

PLASMA DISPLAY PANEL

CROSS REFERENCE TO RELATED APPLICATIONS

This application claims priority to and the benefit of Korean Patent Application No. 10-2004-0093921, filed on Nov. 17, 2004 in the Korean Intellectual Property Office, the entire content of which is incorporated herein by reference

BACKGROUND OF THE INVENTION

1. Field of the Invention

The present invention relates to a plasma display panel, and more particularly, to a plasma display panel which can improve luminous efficiency while reducing a discharge firing voltage.

2. Discussion of the Background

In a plasma display panel ("PDP"), there is a three-electrode surface discharge type structure. The three-electrode surface discharge type structure includes substrate including sustain electrodes and scan electrodes which are formed on the same surface and another substrate which is spaced therefrom at a predetermined distance and has address electrodes arranged in perpendicular to the sustain electrodes and the scan electrodes. Also, a discharge gas is injected between the substrates. The discharge is determined by the discharge of the address electrodes and the scan electrodes which are connected to the lines, respectively, and are independently controlled, and the sustain discharge that displays a screen image by the sustain electrode and the scan electrode located on the same surface.

The PDP generates visible light using glow discharge, and several steps are performed from the step of generating glow discharge to the step in which visible light reaches the human eyes. That is, if the glow discharge is generated, plasma excited by collisions of electrons and gas is generated and then ultraviolet rays are generated from the excited plasma. Ultraviolet rays collide against a phosphor layer in a discharge cell to generate visible light and visible light passes through a transparent substrate to reach the eyes of a person. By these steps, an input energy applied to the sustain electrode and the scan electrode is significantly lost.

The glow discharge is generated by applying a voltage higher than a discharge firing voltage to two electrodes. That is, in order to initiate this discharge, a significantly high voltage is required. If the discharge is generated, a voltage distribution between an anode and a cathode is distorted by the space charge effect generated in a dielectric layer adjacent to the anode and the cathode. Formed between the electrodes are a cathode sheath region and an anode sheath region. The cathode sheath region adjacent the cathode consumes most of the voltage applied to the two electrodes for discharge. The anode sheath region adjacent the anode consumes another portion of the voltage. A positive column region formed between the anode and cathode regions barely consumes any of the voltage. In the cathode sheath region, electron heating efficiency depends on a secondary electron coefficient of an MgO protective film formed on the dielectric layer and, in the positive column region, most of the input energy is consumed for electron heating.

Vacuum ultraviolet rays for colliding against the phosphor layer and emitting visible light are generated when xenon (Xe) gas in an excitation state is transitioned to a ground state. The excitation state of Xe occurs by the collision of Xe gas and electrons. Accordingly, in order to increase a ratio of the input energy for generating visible light (that is, luminous efficiency), the collision of xenon (Xe) gas and the electrons must be increased. Also, in order to increase the collision of xenon (Xe) gas and the electrons, the electron heating efficiency must be increased.

In the cathode sheath region, most of the input energy is consumed and the electron heating efficiency is low, but, in the positive column region, the input energy is barely consumed and the electron heating efficiency is very high. Accordingly, by increasing the area or the length of the positive column region (discharge gap), high luminous efficiency can be obtained.

Moreover, it is known that, in the ratio of the electrons which are consumed according to a change in a ratio E/n of electric field E across the discharge gaps (positive column region) to gas density n, the electron consuming ratio in the same ratio E/n increases in the order of xenon excitation ($Xe^*$), xenon ion ($Xe^+$), neon excitation ($Ne^*$), and neon ion ($Ne^+$). Also, it is known that, in the same ratio E/n, the electron energy decreases as the partial pressure of xenon (Xe) increases. If the partial pressure of xenon (Xe) increases, the ratio of electrons which are consumed for exciting xenon (Xe) increases, among xenon excitation ($Xe^*$), xenon ion ($Xe^+$), neon excitation ($Ne^*$), and neon ion ($Ne^+$), thereby improving luminous efficiency.

As described above, increasing the area of the positive column region increases the electron heating efficiency. Also, the increasing of the xenon (Xe) partial pressure increases the electron heating ratio consumed for xenon excitation ($Xe^*$) in the electrons. Accordingly, by increasing both the area and the length of the positive column region and the partial pressure of xenon (Xe) the electron heating efficiency increases and thus the luminous efficiency can be improved.

However, there is a problem in that the increasing the area or the length of the positive column region and the partial pressure of xenon (Xe) increases a discharge firing voltage and the cost of manufacturing the PDP.

Accordingly, to increase the luminous efficiency, the increase of the area or the length of positive column region and increase of the xenon (Xe) partial pressure needs to occur while maintaining a low discharge firing voltage.

For a given discharge gap distance and a given pressure, the discharge firing voltage required for a surface discharge structure is higher than the discharge firing voltage required for an opposed discharge structure.

SUMMARY OF THE INVENTION

The present invention provides a plasma display panel which can increase luminous efficiency while reducing a discharge firing voltage by providing an opposed discharge structure.

A plasma display panel provided by the invention may include a first substrate and a second substrate which are opposite to each other at a predetermined interval and are provided with a plurality of discharge cells defined in a space formed therebetween. Address electrodes may extend along a first direction between the first substrate and the second substrate. First electrodes may be arranged on both sides of the discharge cell along a second direction that crosses the first direction and may be spaced apart from the address electrode between the first substrate and the second substrate; and second electrodes which pass through the discharge cell and are arranged between the first electrodes in parallel. The first electrodes and the second electrodes project toward the second substrate in a direction away from the first substrate and are arranged to oppose each other across a discharge cell. The address electrodes have protrusions which are protruded toward the inside of the discharge cell between the first electrodes and the second electrodes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DESCRIPTION OF THE ILLUSTRATED EMBODIMENTS

Figure 1:
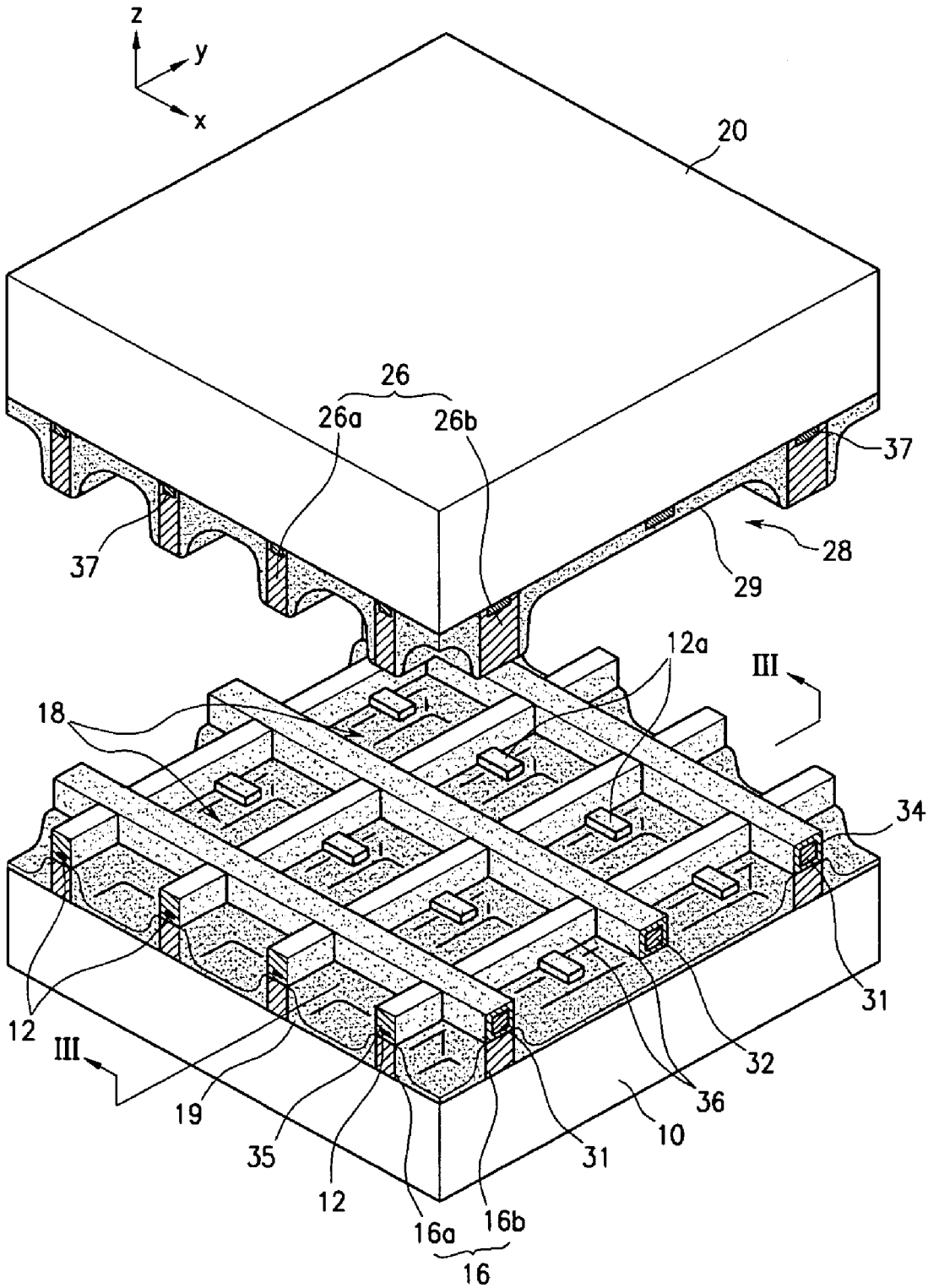
FIG. 1 is a partial exploded perspective view showing a plasma display panel according to a first embodiment of the present invention.

The present invention will now be described in detail with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, portions which are not related to the description will be omitted for clarity. Like reference numerals in the drawings denote like elements.

Figure 2:
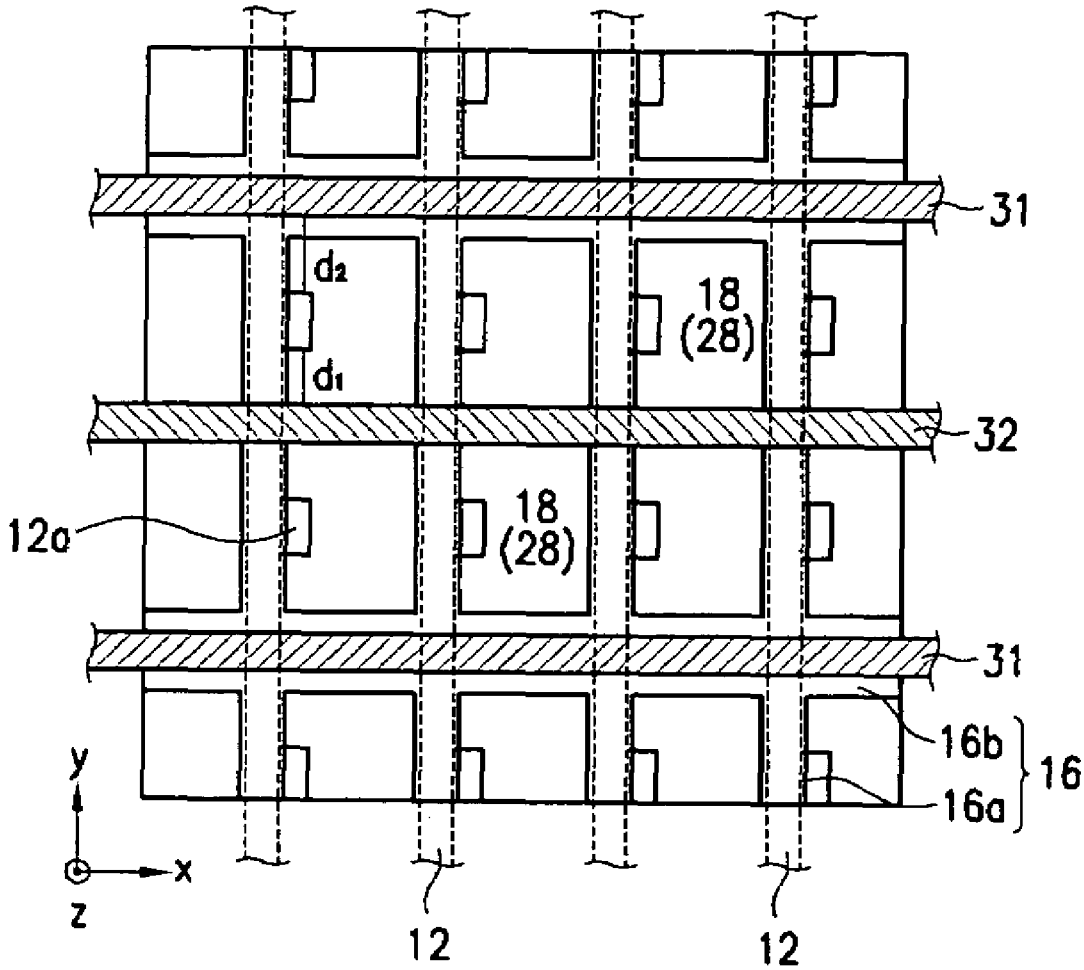
FIG. 2 is a partial plan view schematically illustrating the structure of electrodes and discharge cells in the plasma display panel according to the first embodiment of the present invention.
Figure 3:
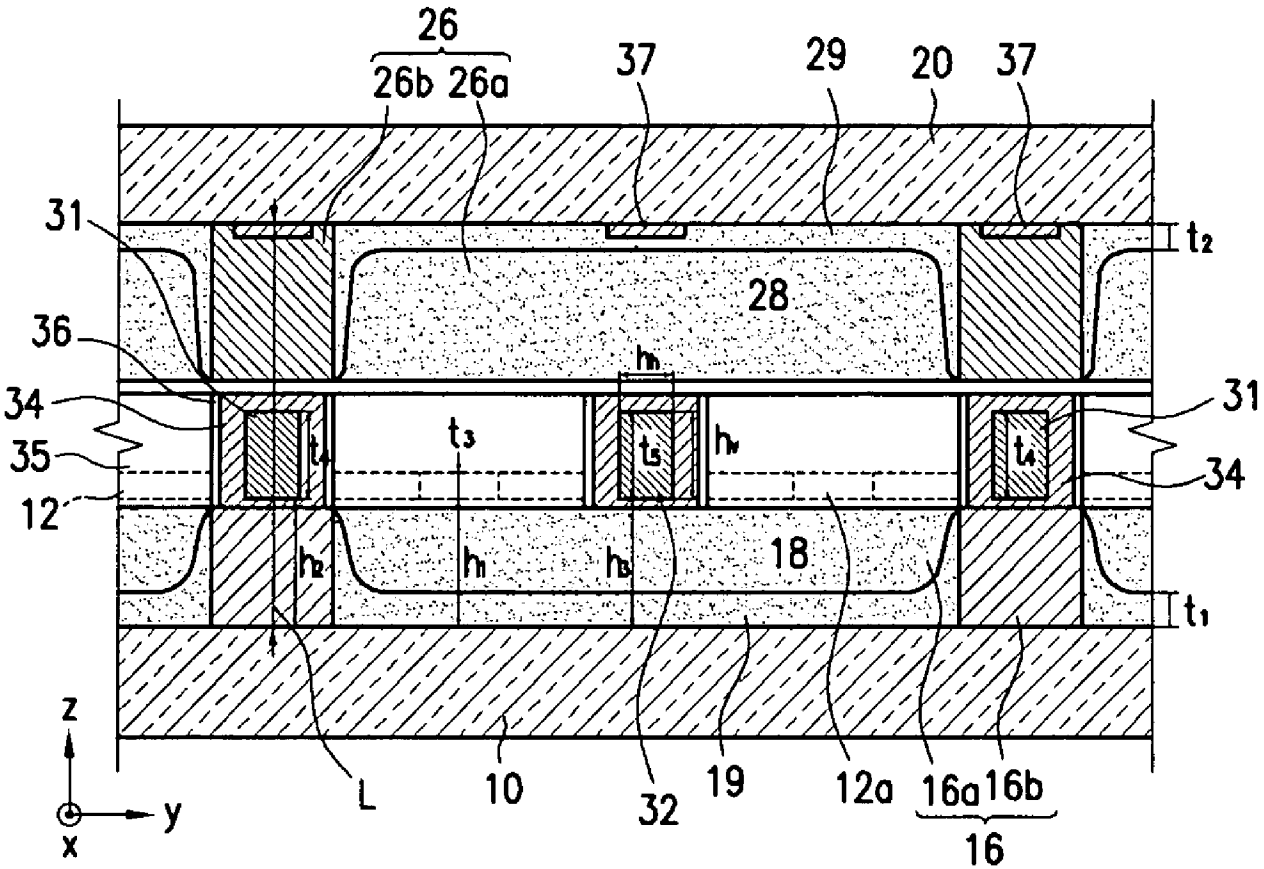
FIG. 3 is a partial cross-sectional view taken along the line Ill-Ill in the state of assembling the plasma display panel of FIG. 1.

FIG. 1 is a partial exploded perspective view showing a plasma display panel according to a first embodiment of the present invention, FIG. 2 is a partial plan view schematically illustrating the structure of electrodes and discharge cells in the plasma display panel according to the first embodiment of the present invention, and FIG. 3 is a partial cross-sectional view taken along the line Ill-Ill in the state of assembling the plasma display panel of FIG. 1.

With reference to these figures, the PDP of the present invention may include a first substrate 10 (hereinafter, referred to as 'rear substrate') and a second substrate 20 (hereinafter, referred to as 'front substrate') which are opposite to each other at a predetermined interval, and discharge cells 18 and 28 which are formed by defining a plurality of discharge spaces between the rear substrate 10 and the front substrate 20. Also, the discharge cells 18 and 28 are defined by a first barrier rib layer 16 (hereinafter, referred to as 'rear barrier rib') and a second barrier rib layer 26 (hereinafter, referred to as 'front barrier rib'). In the discharge cells 18 and 28, phosphor layers 19 and 29 for absorbing vacuum ultraviolet rays and emitting visible light are formed, and discharge gas (for example, gas mixture containing xenon (Xe) and neon (Ne)) is filled in the discharge cells 18 and 28 so as to generate vacuum ultraviolet rays by plasma discharge.

The first barrier rib 16 and the second barrier rib 26 are placed between the rear substrate 10 and the front substrate 20. The rear barrier rib 16 is protruded toward the front substrate 20 adjacent to the rear substrate 10 and the front barrier rib 26 is protruded toward the rear substrate 10 adjacent to the front substrate 20. Also, the front barrier rib 26 corresponds to the rear barrier rib 16.

The rear barrier rib 16 defines the plurality of the discharge cells 18 adjacent to the rear substrate 10, and the front barrier rib 26 defines the plurality of the discharge cells 28 adjacent to the front substrate 20. A discharge cell 18 and a discharge cell 28 substantially combine to form a discharge cell having two discharge spaces separated by a scan electrode 32. Preferably, one discharge cell 18 is smaller in area and/or volume than the corresponding other discharge cell 28. Manufacturing a PDP to have this structure may improve transmittance of visible light from the discharge cells 18 and 28 to the front of the substrate 10.

The rear barrier rib 16 and the front barrier rib 26 may form the discharge cells 18 and 28 in various shapes such as rectangular shape or hexagonal shape, and, in the present embodiment, the rectangular discharge cells 18 and 28 are illustrated.

The rear barrier rib 16 may include a first barrier rib member **16*a* formed on the rear substrate 10 and the front barrier rib 26 may include a second barrier rib member 26*a* formed on the front substrate 20. That is, the first barrier rib member 16*a* extends in a first direction (hereinafter, referred to as 'lengthwise direction of the address electrode' or 'y-axis direction') and the second barrier rib member 26***a* corresponds to the first barrier rib member 16*a* and extends in the direction in which the address electrode 12 extends. In the present embodiment, the rear barrier rib 16 further includes a third barrier rib member 16*b* crossing the first barrier rib member 16*a*, and the front barrier rib 26 further includes a fourth barrier rib member 26*b* corresponding to the third barrier rib member 16*b* and crossing the second barrier rib member 26*a*.

Accordingly, the first barrier rib member 16*a* and third barrier rib member 16*b* defines the discharge cell 18 at the side of the rear substrate 10 into independent discharge spaces, and second barrier rib member 26*a* and the fourth barrier rib member 26*b* defines the discharge cell 28 at the side of the front substrate 20 into independent discharge spaces.

The phosphor layers 19 and 29 are formed in the discharge cells 18 and 28 which are defined by the rear barrier rib 16 and the front barrier rib 26, respectively. That is, the phosphor layer 19 and 29 includes a first phosphor layer 19 formed on the rear substrate 10 in the discharge cell 18 and a second phosphor layer 29 formed on the front substrate 20 in the discharge cell 28 which is opposite to the discharge cell 18. Accordingly, visible light is generated on both sides of the discharge cells 18 and 28 which are substantially one discharge cell and the luminous efficiency is improved.

Since the discharge cell 18 formed by the rear barrier rib 16 and the discharge cell 28 formed by the front barrier rib 26 substantially compose one discharge cell, it is preferable that the first phosphor layer 19 and the second phosphor layer 29 which are formed therein are formed of the same color phosphor material so that visible light of the same color is generated by the collision of the vacuum ultraviolet rays generated by gas discharge.

The first phosphor layer 19 may be formed on the inner surfaces of the first barrier rib member 16*a* and the third barrier rib member 16*b* in the discharge cell 18 and the surface of the rear substrate 10 in the discharge cell 18, and the second phosphor layer 29 may be formed on the inner surfaces of the second barrier rib member 26*a* and the fourth barrier rib member 26*b* and the surface of the front substrate 20 in the discharge cell 28.

On the other hand, the first phosphor layer 19 may be formed by forming a dielectric layer (not shown) on the rear substrate 10, forming the rear barrier rib 16, and coating phosphor material on the dielectric layer. Alternatively, the first phosphor layer 19 may be formed by forming the rear barrier rib 16 on the rear substrate 10 and coating the phosphor material, without forming the dielectric layer on the rear substrate 10.

Similarly, the second phosphor layer 29 may be formed by forming a dielectric layer on the front substrate 20, forming the front barrier rib 26, and coating phosphor material on the dielectric layer. Alternatively, the second phosphor layer 29 may be formed by forming the front barrier rib 26 on the front substrate 20 and coating the phosphor material, without forming the dielectric layer on the front substrate 20.

Further, the first phosphor layer 19 and the second phosphor layer 29 may be formed by etching the rear substrate 10 and the front substrate 20 to correspond to the shapes of the discharge cells 18 and 28 and then coating phosphor material thereon, respectively. The rear barrier rib 16 and the rear substrate 10 may be composed of the same material, and the front barrier rib 26 and the front substrate 20 may be composed of the same material.

After sustain discharge, the first phosphor layer 19 absorbs the vacuum ultraviolet rays to generate visible light directed toward the front substrate 20 in the one discharge cell 18 and the second phosphor layer 29 absorbs the vacuum ultraviolet rays to generate visible light directed toward the front substrate 20 in the other discharge cell 28. Also, since the second phosphor layer 29 transmits visible light, it is preferable that the thickness $t_1$ of the first phosphor layer 19 formed on the rear substrate 10 is larger than the thickness $t_2$ of the second phosphor layer 29 formed on the front substrate 20 ($t_1>t_2$). Accordingly, the loss of the vacuum ultraviolet rays is minimized and thus the luminous efficiency can increase.

The vacuum ultraviolet rays collide with the first phosphor layer 19 and the second phosphor layer 29. In order to generate the vacuum ultraviolet rays by the plasma discharge to realize an image, an address electrode 12, a first electrode 31 ("sustain electrode"), and a second electrode 32 ("scan electrode") corresponding to each of the discharge cells 18 and 28 are provided between the rear substrate 10 and the front substrate 20.

The address electrode 12 extends along the y-axis direction between the rear barrier rib 16 and the front barrier rib 26, with respect to the z-axis direction of the rear substrate 10 and the front substrate 20. That is, the address electrode 12 extends along the direction (y-axis direction) parallel with the first barrier rib member 16*a*. Also, the address electrodes 12 are arranged in parallel with each other in the x-axis direction at an interval corresponding to the discharge cell 18.

The address electrode 12 is provided to pass along the boundary of the s discharge cells 18 and 28 which are adjacent to each other in the direction (x-axis direction) crossing the address electrode 12. That is, as shown in FIG. 2, since the address electrode 12 corresponds to the center of the first barrier rib member 16*a*, the halves of the width thereof correspond to the discharge cells 18 and 28 adjacent to each other in the x-axis direction.

On the other hand, the sustain electrode 31 and the scan electrode 32 are formed between the rear barrier rib 16 and the front barrier rib 26 composing the discharge cells 18 and 28 with respect to the z-axis direction of the rear substrate 10 and the front substrate 20. Also, the sustain electrode 31 and the scan electrode 32 are formed in parallel along the direction (x-axis direction) crossing the address electrode 12, while being spaced from the address electrode 12. The sustain electrodes 31 are arranged on both sides of the discharge cells 18 and 28 and the scan electrodes 32 pass through the centers of the discharge cells 18 and 28 and are arranged between the sustain electrodes 31 in parallel.

Also, as shown in FIG. 3, the sustain electrode 31 is located between the third barrier rib member 16*b* formed on the rear substrate 10 and the fourth barrier rib member 26*b* formed on the front substrate 20. Further, in the direction (z-axis direction) perpendicular to the front substrate 20 and the rear substrate 10, the cross section of the sustain electrode 31 and the cross sections of the third and fourth barrier rib member 16*b* and 26*b* have symmetrically straight center line L. Accordingly, in the discharge cells 18 and 28, the sustain discharge is generated between one sustain electrode 31 and the scan electrode 32 and between the other sustain electrode 31 and the scan electrode 32.

Accordingly, it is preferable that, in the discharge cells 18 and 28, the address discharge can be generated between one sustain electrode 31 and the scan electrode 32 and between the other sustain electrode 31 and the scan electrode 32.

For this, the address electrode 12 includes a protrusion 12*a* protruded toward the centers of the discharge cells 18 and 28. The protrusion 12*a* is protruded between the sustain electrode 31 and the scan electrode 32. The protrusion 12*a* of the address electrode 12 applies an address pulse applied to the address electrode 12 to the discharge cells 18 and 28 and forms the discharge gap with the scan electrode 32 by a short gap in the discharge cells 18 and 28. Accordingly, the address discharge voltage can be reduced.

Figure 4:
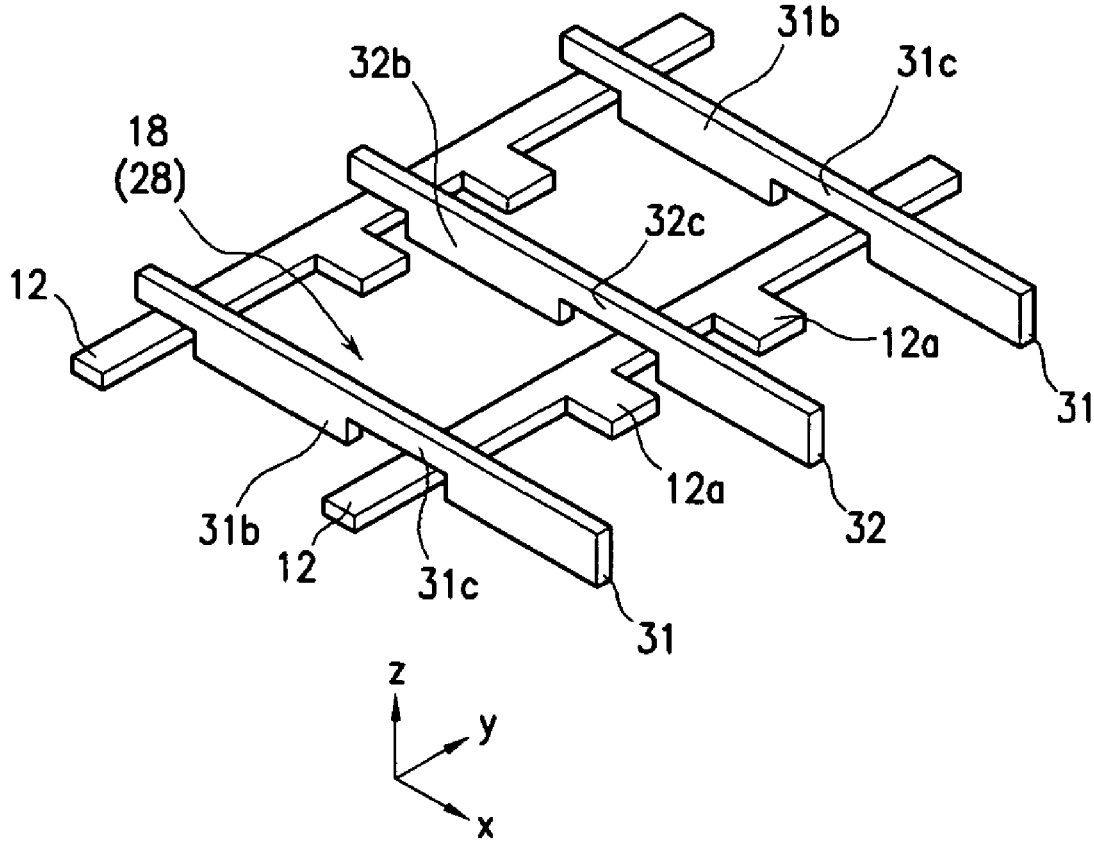
FIG. 4 is a partial perspective view schematically illustrating the structure of electrodes in the plasma display panel according to the first embodiment of the present invention.

As shown in FIG. 4, in order to generate the address discharge on both sides of the discharge cells 18 and 28, it is preferable that two protrusion 12*a* of the address electrode 12 are formed in the discharge cells 18 and 28. That is, the protrusions 12*a* are provided between the one sustain electrode 31 and the scan electrode 32 and the scan electrode 32 and the other sustain electrode 31 in the discharge cells 18 and 28, respectively. Accordingly, the address discharge is generated on both sides of the scan electrode 32.

That is, the sustain electrode 31 extends between the third barrier rib member 16*b* and the fourth barrier rib member 26*b* in the direction (x-axis direction) parallel with the third barrier rib member 16*b* and the fourth barrier rib member 26*b*, and the scan electrode 32 extends between the first barrier rib member 16*a* and the second barrier rib member 26*a* in the direction (x-axis direction) crossing the first barrier rib member 16*a* and the second barrier rib member 26*a*. In particular, the sustain electrodes 31 are arranged on both sides of the discharge cells 18 and 28 as a pair and the scan electrode 32 traverses the center of the discharge cells 18 and 28. In the present embodiment, since the sustain electrode 31 is placed between the third barrier rib member 16*b* and the fourth barrier rib member 26*b* one by one, it may be a reference for defining the discharge cells 18 and 28 which are adjacent to each other in the lengthwise direction (y-axis direction) of the address electrode 12. Also, the sustain electrode 31 passes along the boundary of a pair of discharge cells 18 which are adjacent to each other in the lengthwise direction of the address electrode 12 and thus participates in the sustain discharge of two discharge cells 18.

The scan electrode 32 participates in the address discharge of the address period together with the address electrode 12 to select the discharge cells 18 and 28 to be turned on. The sustain electrode 31 and the scan electrode 32 participate in the sustain discharge of the discharge sustain period to display a screen image. That is, the sustain pulse is applied to the sustain electrode 31 in the discharge sustain period, and the sustain pulse is applied to the scan electrode 32 in the discharge sustain period and the scan pulse is applied to the scan electrode 32 in the address period. However, since each electrode may perform the other functions according to the applied signal voltage, the present invention is not limited to this arrangement.

The sustain electrode 31 and the scan electrode 32 are provided between both substrates 10 and 20 to define the discharge cells 18 and 28 which are substantially one discharge cell including two discharge spaces separated by the scan electrode 32. This opposed discharge structure can further reduce the discharge firing voltage for the sustain discharge to a value that is less than a discharge firing voltage obtained using a surface discharge structure.

Also, to generate the opposed discharge in a wider region of the sustain electrode 31 and the scan electrode 32, expansion portions 31*b* and 32*b* which are expanded in the direction (z-axis direction) perpendicular to the rear substrate 10 at portions corresponding to the discharge cells 18 and 28 of the sustain electrode 31 and the scan electrode 32 are included, respectively. Also, the sustain electrode 31 and the scan electrode 32 include narrow portions 31*c* and 32*c* at a portion corresponding to the boundary of a pair of discharge cells which are adjacent to each other in the x-axis direction. The expansion portions 31*b* and 32*b* have cross sectional structures of which the vertical length $h_v$ is longer than the horizontal length $h_h$. The opposed discharge formed in the expansion portions 31*b* and 32*b* generate strong vacuum ultraviolet rays and these strong vacuum ultraviolet rays collide with the phosphor layers 19 and 29 formed with wide areas in the discharge cells 18 and 28 and an amount of visible light is generated by this collision.

As shown in FIG. 4, the sustain electrode 31 and the scan electrode 32 extend in the direction crossing the address electrode 12. Also, the sustain electrode 31 and the scan electrode 32 include the expansion portion 31*b* and 32*b* which are formed in the direction perpendicular to the rear substrate 10 and the front substrate 20 and the narrow portions 31*c* and 32*c* which are formed in the portion corresponding to the boundary of a pair of discharge cells which are adjacent to each other in the direction crossing the address electrode 12. Accordingly, the sustain electrode 31 and the scan electrode 32 are formed to smoothly cross the address electrode 12 in a straight line without interfering with the address electrode 12 including the protrusion 12*a*.

Also, as shown in FIG. 3, the distance $h_1$ between the protrusion 12*a* of the address electrode 12 and the rear substrate 10 may equal to the distance $h_2$ between the sustain electrode 31 and the rear substrate 10 and the distance $h_3$ between the scan electrode 32 and the rear substrate 10. Accordingly, on both sides of the scan electrode 32, the scan electrode 32 and the protrusion 12*a* of the address electrode 12 perform the opposed discharge. The thickness $t_3$ of the address electrode 12 in the direction perpendicular to the substrate may be less than the thickness $t_4$ of the sustain electrode 31 and the thickness $t_5$ of the scan electrode 32. Accordingly, the sustain discharge is not obstructed by the address electrode 12, and thus the luminous efficiency is improved.

The sustain electrode 31 and the scan electrode 32 form the opposed discharge in the discharge cells 18 and 28 and thus the discharge firing voltage can be reduced. Also, since the sustain discharge is generated on both sides of the discharge cells 18 and 28, the luminous efficiency is improved.

It is preferable that the sustain electrode 31, the scan electrode 32, and the address electrode 12 are formed of metal electrodes having excellent conductivity.

Dielectric layers 34 and 35 are formed on the outer surfaces of the sustain electrode 31, the scan electrodes 32, and the address electrode 12. The dielectric layers 34 and 35 store wall charges and form the insulating structure of the electrodes. The sustain electrode 31, the scan electrode 32, and the address electrode 12 may be manufactured by a TFCS (Thick Film Ceramic Sheet) method. That is, the electrode portion including the sustain electrode 31, the scan electrode 32, and the address electrode 12 are separately made and then are coupled to the rear substrate 10 having the barrier rib 16 formed thereon.

An MgO protective film 36 may be formed on the surfaces of the dielectric layers 34 and 35 covering the sustain electrode 31, the scan electrode 32, and the address electrode 12. Particularly, the MgO protective film 36 may be formed on a portion which is exposed to the plasma discharge generated in the discharge space in the discharge cell 18. In the present embodiment, since the sustain electrode 31, the scan electrode 32, and the address electrode 12 are formed between the front substrate 20 and the rear substrate 10, not on the substrates 10 and 20, the MgO protective film 36 coated on the dielectric layers 34 and 35 which covers the sustain electrode 31, the scan electrode 32, and the address electrode 12 may be composed of MgO having non-visible-light-transmission characteristics. This non-visible-light-transmission MgO has a secondary electron emission coefficient much larger than that of the visible-light-transmission MgO, and thus the discharge firing voltage can be further reduced.

On the other hand, since the sustain electrode 31 is provided between the third barrier rib member 16*b* and the fourth barrier rib member 26*b* in correspondence with the third and fourth barrier rib members 16*b* and 26*b* forming both sides (both sides of the y-axis direction) of the discharge cells 18 and 28, the scan electrode 32 passes through the discharge cells 18 and 28 between the sustain electrodes 31, and the address electrode 12 is provided between the first barrier rib member 16*a* and the second barrier rib member 26*a* in correspondence with the first and second barrier rib members 16*a* and 26*a* forming the other sides (both sides of the x-axis direction) of the discharge cells 18 and 28, the protrusion 12*a* of the address electrode 12 is placed adjacent to the scan electrode 32 so as to select one of the discharge cells 18 and 28 in the address period. More specifically, the protrusion 12*a* of the address electrode 12 is placed adjacent to the scan electrode 32 participating in the address discharge of the discharge cells 18 and 28 and apart from the sustain electrode 31 such that the discharge cells 18 and 28 are selected by the address pulse applied to the address electrode 12 and the scan pulse applied to the scan electrode 32. That is, the protrusion 12*a* of the address electrode 12 may be formed to be biased to the scan electrode 32.

That is, the distance $d_1$ between the protrusion 12*a* of the address electrode 12 and the scan electrode 32 may be less than the distance $d_2$ between the protrusion 12*a* of the address electrode 12 and the sustain electrode 31 ($d_1<d_2$) (see FIG. 2). Also, since the address electrode 12 is surrounded by the dielectric layer 35 having the same permittivity, the same discharge firing voltage of red (R), green (G), and blue (B) is formed and a high voltage margin is formed. Alternatively, since the sustain electrodes 31 are placed on both sides of the discharge cells 18 and 28 and the address discharge is generated between the scan electrode 32 and the address electrode 12, the distance $d_1$ between the protrusion 12*a* of the address electrode 12 and the scan electrode 32 may be larger than or equal to the distance $d_2$ between the protrusion 12*a* of the address electrode 12 and the sustain electrode 31 ($d_1 \geqq d2$).

Figure 5:
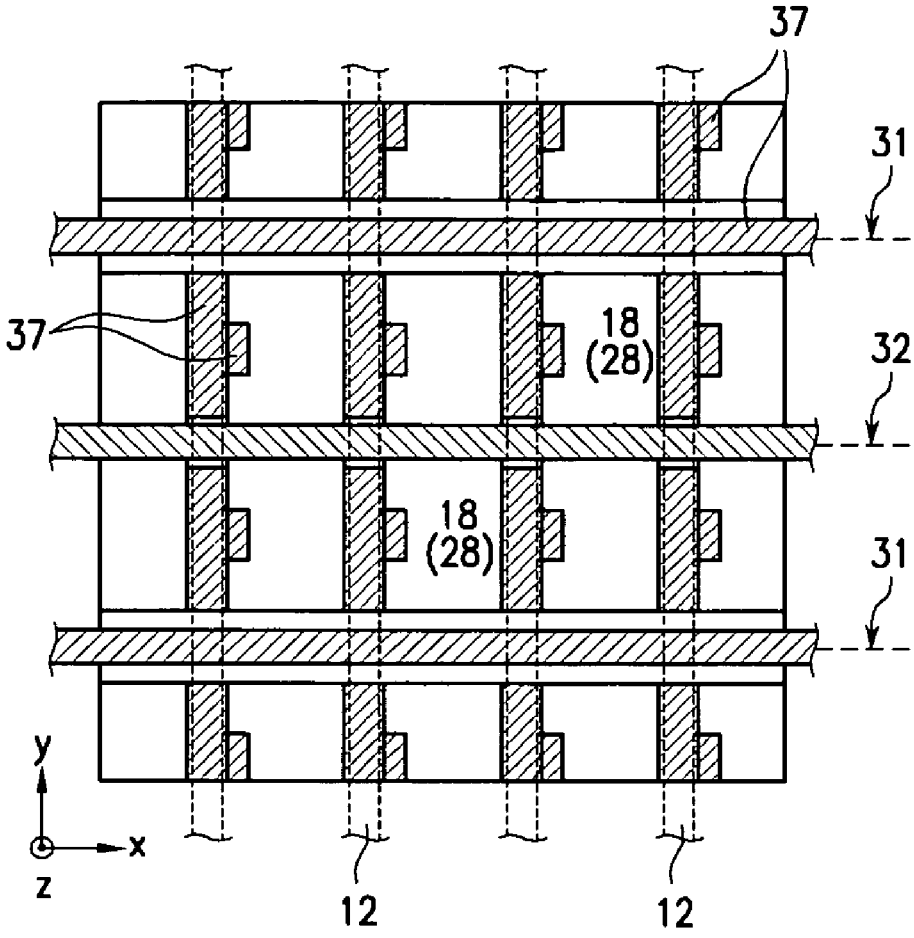
FIG. 5 is a partial plan view schematically illustrating a relationship between a discharge cell and a black layer in the plasma display panel according to the first embodiment of the present invention.

On the other hand, a black layer 37 for absorbing external light to improve contrast may be formed on the front substrate 20, as shown in FIG. 5. The black layer 37 is formed on the surface of the front substrate 20 and then is covered by the second phosphor layer 29, as shown in FIG. 3. Alternatively, after the second phosphor layer 29 is formed on the front substrate 20, the black layer may be formed on the second phosphor layer 29 (not shown).

It is preferable that this black layer 37 be formed adjacent to the front substrate 20 in a shape corresponding to the plane pattern of the address electrode 12, the sustain electrode 31, and the scan electrode 32. By forming the black layer 37 on a location where visible light is blocked by the above-described electrodes, the additional blockage of visible light which transmits through the front substrate 20 may be prevented except for the visible light blocked by the electrodes, and thus the luminous efficiency is improved.

Moreover, since a pair of sustain electrodes 31 is arranged on both sides of the discharge cells 18 and 28 which are arranged in the lengthwise direction (y-axis direction) of the address electrode 12 and the scan electrode 32 is placed between the sustain electrodes 31, the arrangement of the sustain electrode 31, the scan electrode 32, and the sustain electrode 31 is sequentially placed with respect to the discharge cells 18 and 28 which are continuously arranged in the lengthwise direction of the address electrode 12.

At this time, since the address electrode 12 includes the protrusion 12*a*, the arrangement of the sustain electrode 31, the scan electrode 32, and the sustain electrode 31 substantially becomes the arrangement of the sustain electrode 31, the address electrode 12, the scan electrode 32, the address electrode 12, and the sustain electrode 31.

Also, in the arrangement of the sustain electrode 31, the scan electrode 32, and the sustain electrode 31, the sustain electrodes 31 may be commonly connected, or even-numbered sustain electrodes 31 and odd-numbered sustain electrodes 32 may be separately common-connected. In a case of the latter, resolution can be improved.

Hereinafter, various embodiments of the present invention will be described. Since the structures of the below-described embodiments are similar or identical to that of the first embodiment, the same parts will be omitted and only different portions will be described.

Figure 6:
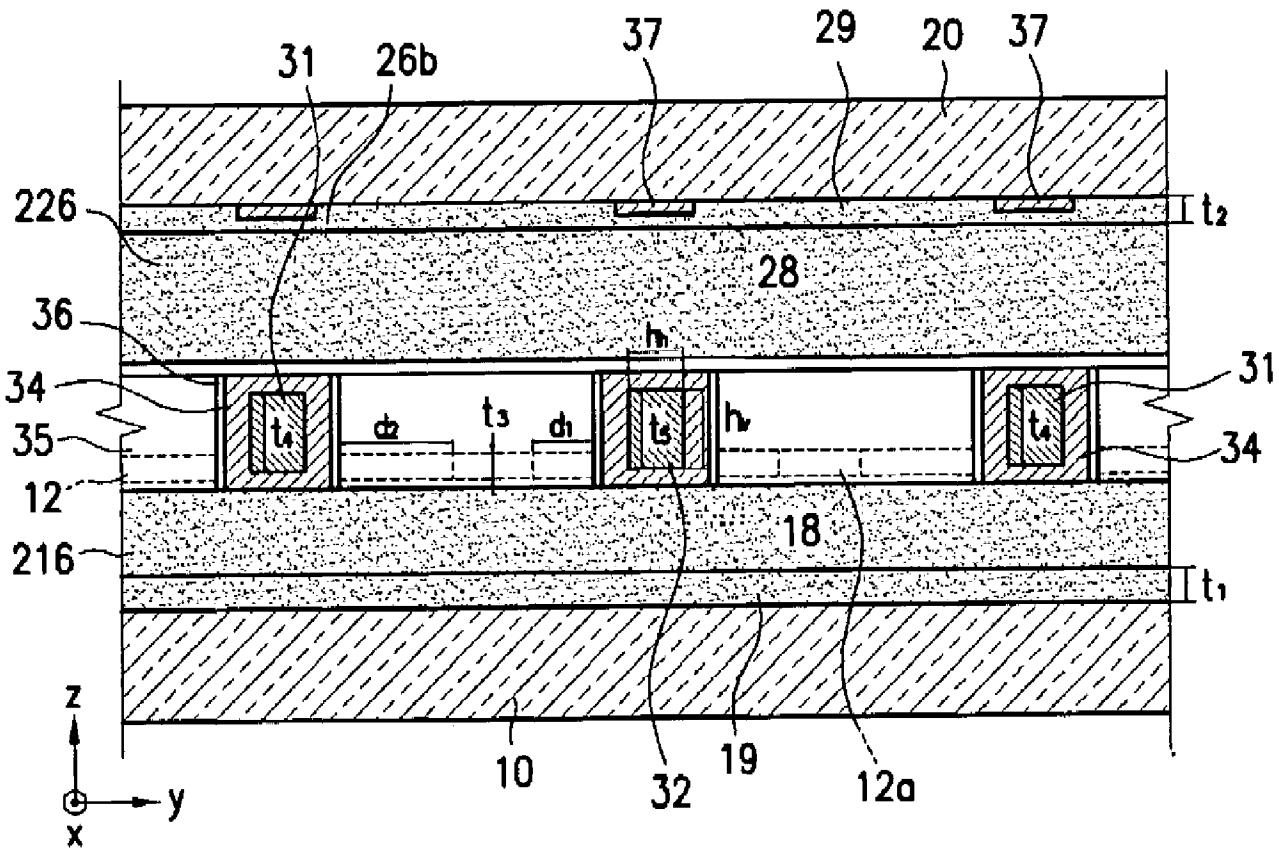
FIG. 6 is a partial cross-sectional view showing a plasma display panel according to a second embodiment of the present invention.

FIG. 6 illustrates a second embodiment of the present invention. In this embodiment, the rear barrier rib 216 is composed of a first barrier rib member that is formed in a direction parallel with the address electrode 12, and the front barrier rib 226 is composed of a second barrier rib member which is formed in a direction parallel with the address electrode 12. Accordingly, the discharge cells 18 and 28 are formed in a stripe shape which is continuously connected in a direction (y-axis direction) in which the address electrode 12 extends.

Figure 7:
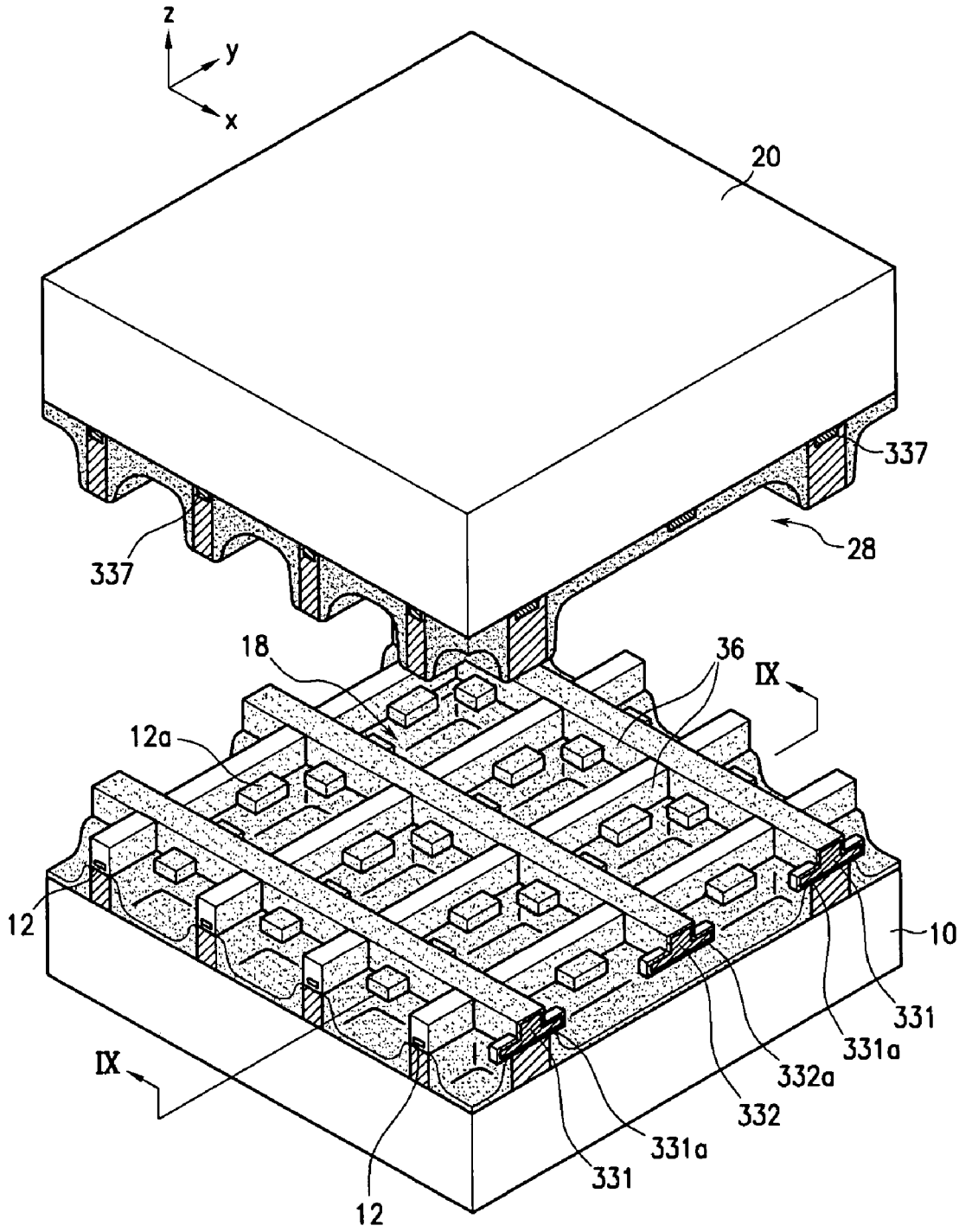
FIG. 7 is a partial exploded perspective view showing a plasma display panel according to a third embodiment of the present invention.
Figure 8:
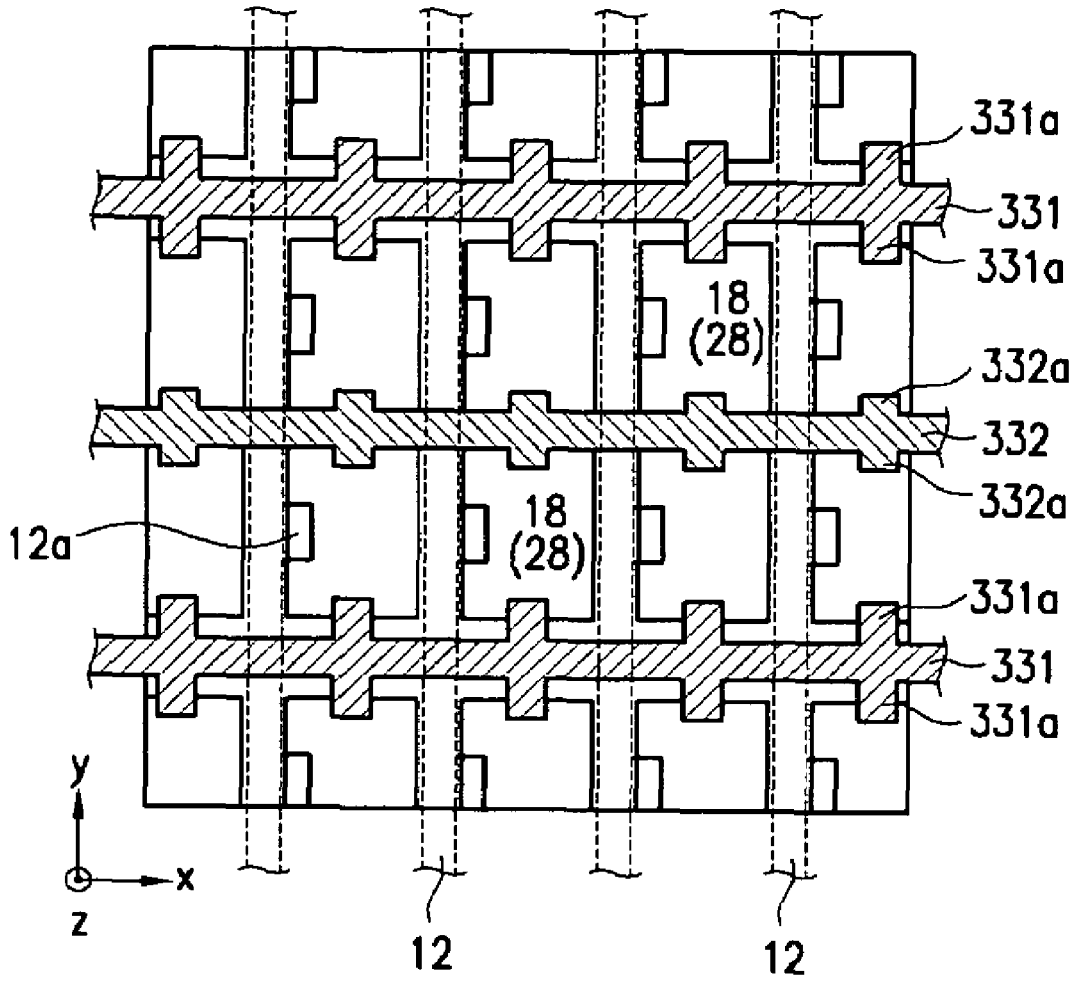
FIG. 8 is a partial plan view schematically illustrating the structure of electrodes and discharge cells in a plasma display panel according to the third embodiment of the present invention.
Figure 9:
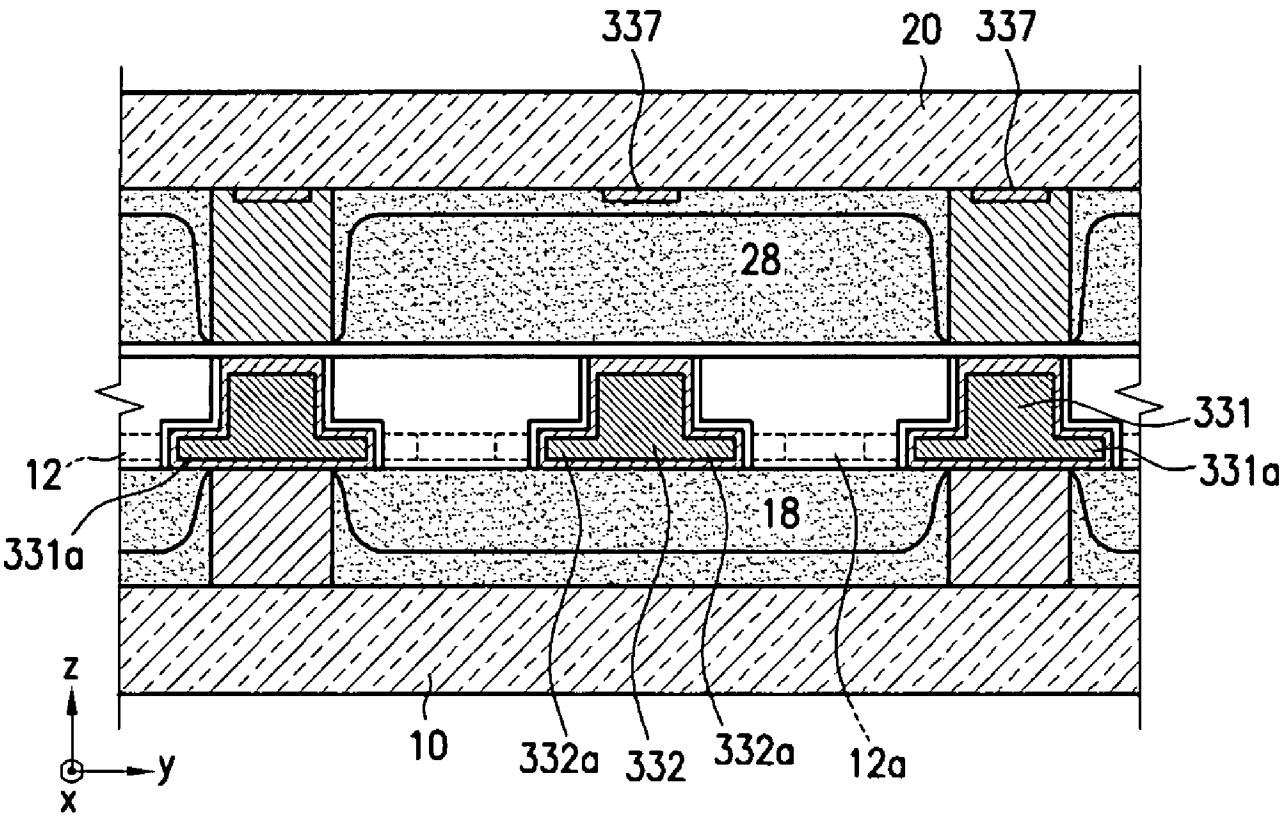
FIG. 9 is a partial cross-sectional view taken along the line IX-IX in the state of assembling the plasma display panel of FIG. 7.
Figure 10:
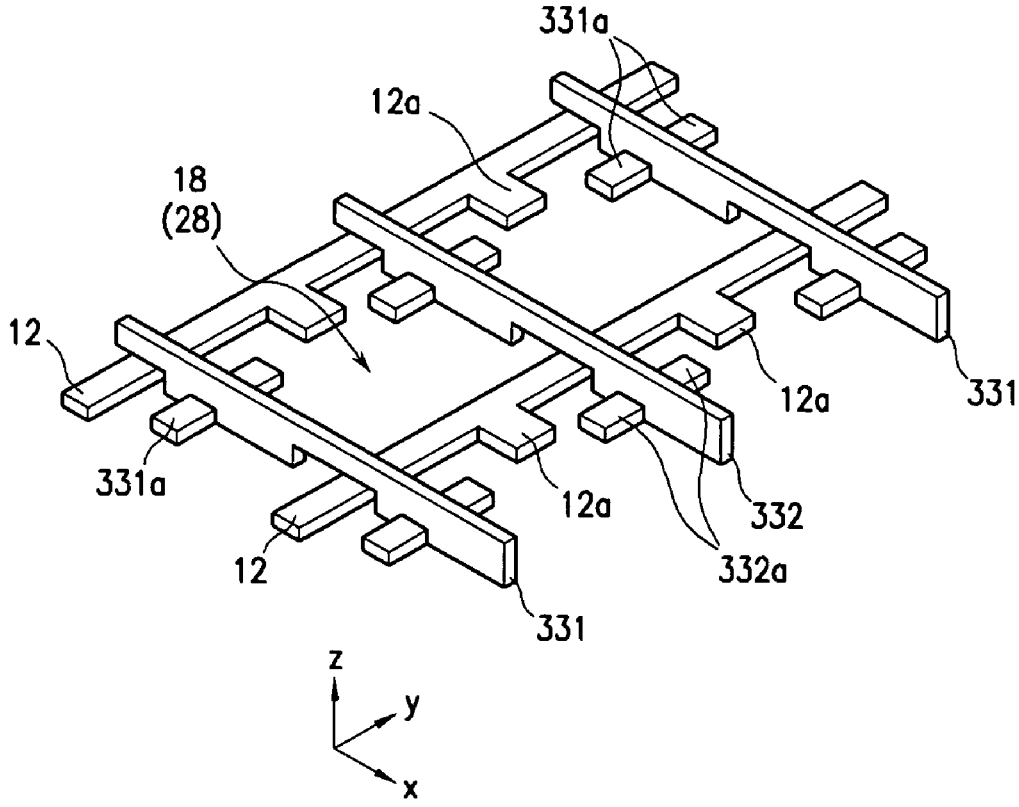
FIG. 10 is a partial perspective view schematically illustrating the structure of electrodes in the plasma display panel according to the third embodiment of the present invention.
Figure 11:
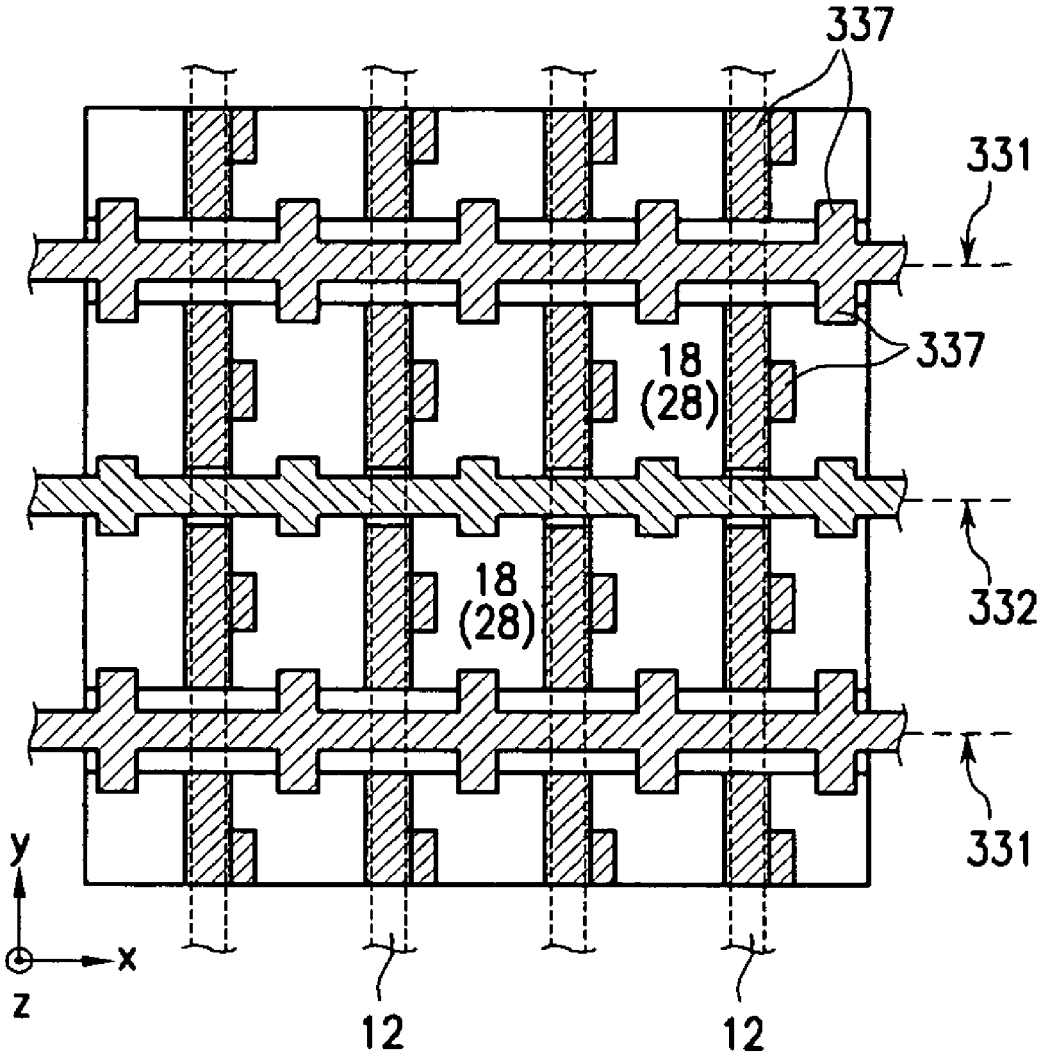
FIG. 11 is a partial plan view schematically illustrating a relationship between a discharge cell and a black layer in the plasma display panel according to the third embodiment of the present invention.

FIG. 7 is a partial exploded perspective view showing a plasma display panel according to a third embodiment of the present invention. FIG. 8 is a partial plan view schematically illustrating the structure of the electrodes and the discharge cells in a plasma display panel according to the third embodiment of the present invention. FIG. 9 is a partial cross-sectional view taken along the line IX-IX in the state of assembling the plasma display panel of FIG. 7. FIG. 10 is a partial perspective view schematically illustrating the structure of the electrodes in the plasma display panel according to the third embodiment of the present invention. And FIG. 11 is a partial plan view schematically illustrating a relationship between a discharge cell and a black layer in the plasma display panel according to the third embodiment of the present invention. These drawings correspond to FIGS. 1 to 5 of the first embodiment, respectively.

In this third embodiment, protrusions 331*a* and 332*a* are provided to a sustain electrode 331 and a scan electrode 332, respectively. That is, the protrusions 331*a* and 332*a* are protruded toward the centers of the discharge cells 18 and 28. The protrusion 12*a* of the address electrode 12 and the protrusion 332*a* of the scan electrode 332 form a shorter gap and thus the address discharge is generated at a low voltage. Also, the protrusion 331*a* of the sustain electrode 331 and the protrusion 332*a* of the scan electrode 332 form a shorter gap at the beginning of the sustain discharge and thus the sustain discharge is generated at a low voltage. Also, a long gap discharge may be performed, compared with the beginning of the sustain discharge, and the sustain discharge is generated on both sides of the discharge cells 18 and 28. Accordingly, the luminous efficiency is improved.

The black layer 337 may be formed in a shape corresponding to the plane pattern of the address electrode 12, the sustain electrode 331, and the scan electrode 332, like the first embodiment, and is preferably formed in a shape corresponding to the plane pattern of the protrusion 331*a* of the sustain electrode 331 and the protrusion 332*a* of the scan electrode 332.

Figure 12:
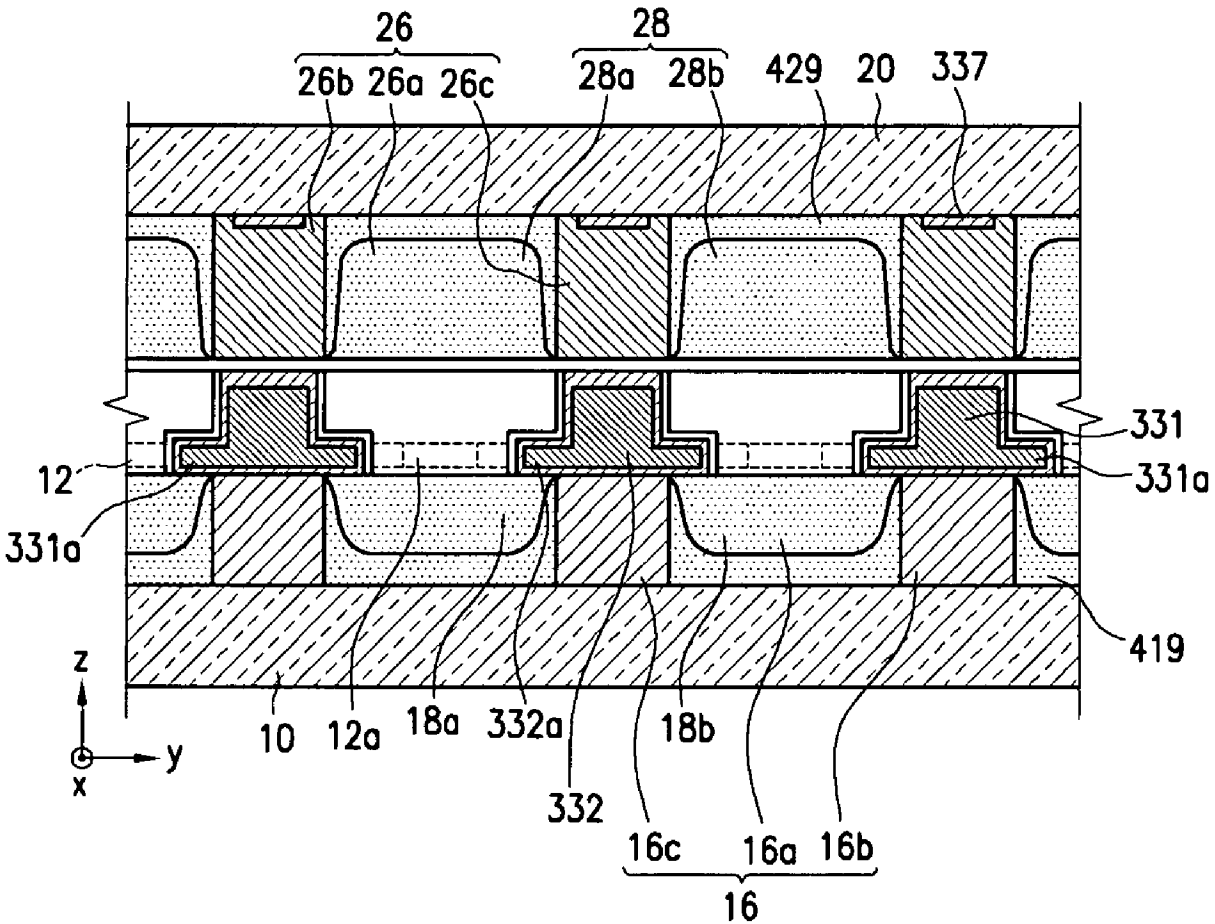
FIG. 12 is a partial cross-sectional view showing a plasma display panel according to a fourth embodiment of the present invention.

FIG. 12 illustrates a fourth embodiment. In addition to the structure of the third embodiment, a fifth barrier rib member 16*c* and a sixth barrier rib member 26*c* are further provided on the rear substrate 10 and the front substrate 20 with the scan electrode 332 interposed therebetween, respectively. That is, the scan electrode 332 is placed between the fifth barrier rib member 16*c* and the sixth barrier rib member 26*c* in parallel, the rear barrier rib 16 is composed of the first, third, and fifth barrier rib members 16*a*, 16*b*, and 16*c*, and the front barrier rib 26 is composed of the second, fourth, and sixth barrier rib members 26*a*, 26*b*, and 26*c*. Accordingly, a first phosphor layer 419 is formed on the inner surfaces of the first, third, fifth barrier rib members 16*a*, 16*b*, and 16*c*, a second phosphor layer 429 is formed on the inner surfaces of the second, fourth, and sixth barrier rib members 26*a*, 26*b*, and 26*c*, and thus the areas of the phosphor layers 19 and 29 are wider and the luminous efficiency is further improved. Also, the discharge cell 18 of the rear substrate 10 is divided into two discharge spaces 18*a* and 18*b* and the discharge cell 28 of the front substrate 20 is divided into two discharge spaces 28*a* and 28*b*.

FIG. 13, FIG. 14, FIG. 15, and FIG. 16 are partial plan views schematically illustrating the structure of the electrodes and the discharge cells in plasma display panels according to a fifth embodiment, a sixth embodiment, a seventh embodiment, and an eighth embodiment of the present invention, respectively.

These drawings show that, since protrusions are provided to the sustain electrode and the scan electrode, the protrusion 12*a* of the address electrode 12, the protrusion 31*a* of the sustain electrode 31, and the protrusion 32*a* of the scan electrode 32 can be formed in various shapes and sizes.

Figure 13:
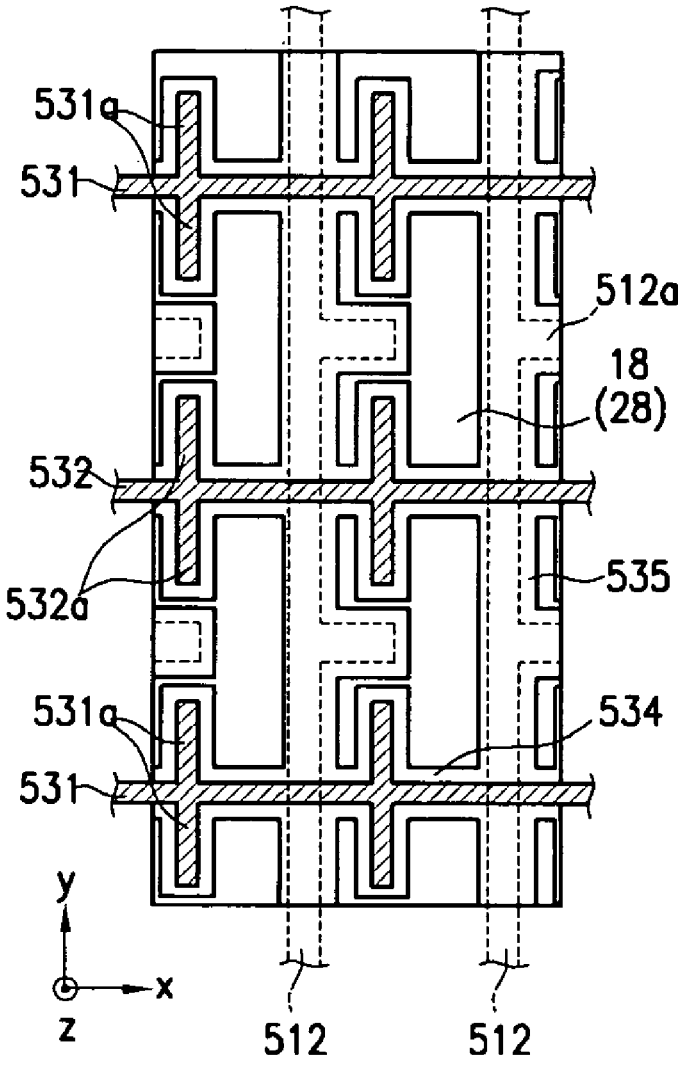
FIG. 13 is a partial plan view schematically illustrating the structures of electrodes and discharge cells in a plasma display panel according to a fifth embodiment of the present invention.

In the embodiment of FIG. 13, a protrusion 531*a* of a sustain electrode 531 and a protrusion 532*a* of a scan electrode 532 are protruded with the same length in one direction (y-axis direction) and a protrusion 512*a* of an address electrode 512 is protruded therebetween. The protrusions 512*a*, 531*a*, and 532*a* are located in the same straight line of the y-axis direction.

Figure 14:
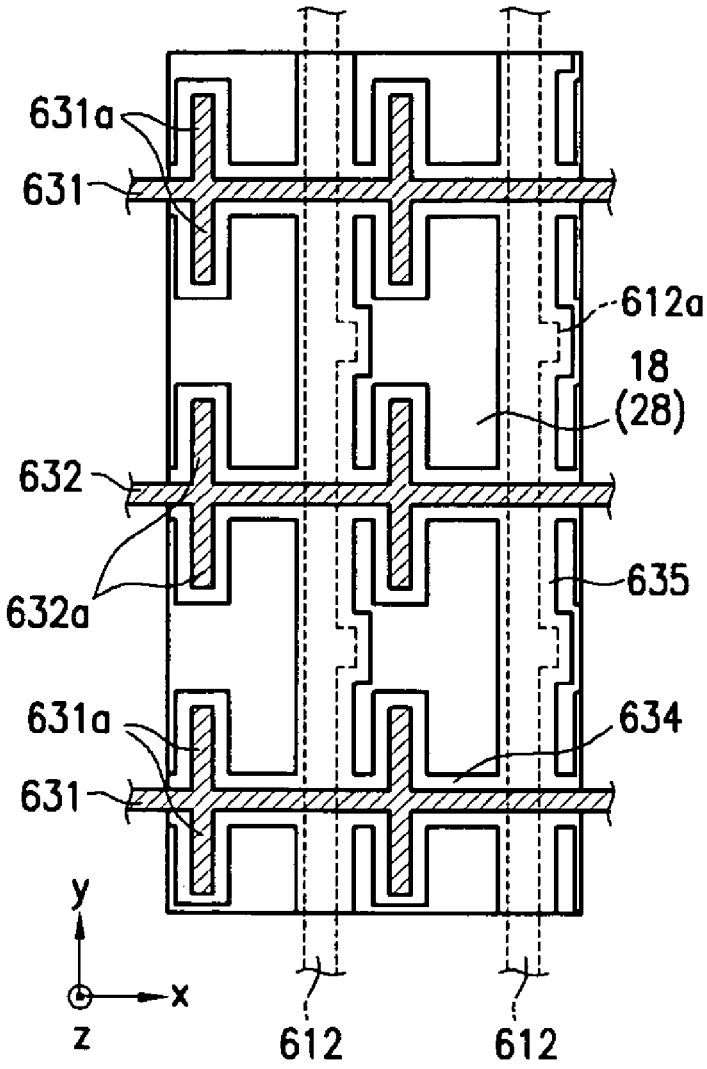
FIG. 14 is a partial plan view schematically illustrating the structures of electrodes and discharge cells in a plasma display panel according to a sixth embodiment of the present invention.

In the embodiment of FIG. 14, a protrusion 631*a* of a sustain electrode 631 and a protrusion 632*a* of a scan electrode 632 are protruded with the same length in one direction (y-axis direction) and a protrusion 612*a* of an address electrode 612 is protruded therebetween. At this time, the protrusion 612*a* of the address electrode 612 is formed such that it does not reach the same straight line of the y-axis direction formed by the protrusions 631*a* and 632*a*.

Figure 15:
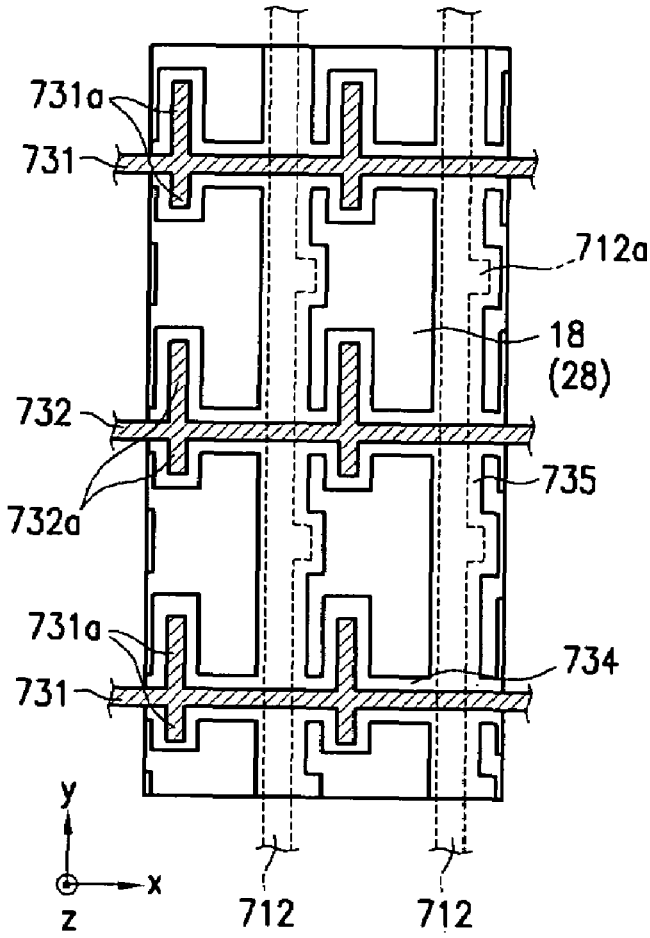
FIG. 15 is a partial plan view schematically illustrating the structures of electrodes and discharge cells in a plasma display panel according to a seventh embodiment of the present invention.

In the embodiment of FIG. 15, in the protrusion length of the y-axis direction, a protrusion 731*a* of one sustain electrode 731 of one discharge cell is long and another protrusion 731*a* on the other side of the sustain electrode 731 is short. One protrusion 732*a* of a scan electrode 732 opposite the long protrusion 731*a* is short, and another protrusion on the other side of the scan electrode 732 is long. The protrusion 712*a* of the address electrode 712 is formed such that it does not reach the same straight line of the y-axis direction formed by the protrusions 731*a* and 732*a*.

Figure 16:
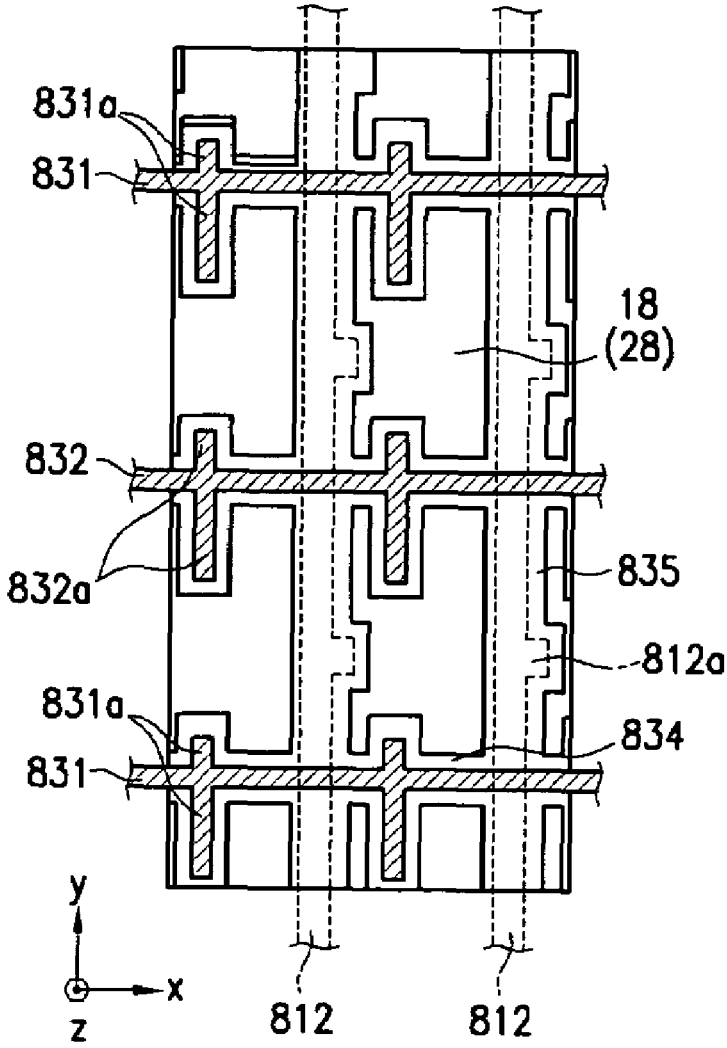
FIG. 16 is a partial plan view schematically illustrating the structures of electrodes and discharge cells in a plasma display panel according to an eighth embodiment of the present invention.

In the embodiment of FIG. 16, in the protrusion length of the y-axis direction, a protrusion 831*a* of one sustain electrode 831 of one discharge cell is long and another protrusion 831*a* on the other side of sustain electrode 831 is short. One protrusion 832*a* of a scan electrode 832 opposite the long protrusion 831*a* is short and the other protrusion 832*a* of a scan electrode 832 is long. A protrusion 812*a* of an address electrode 812 is protruded between the protrusions 831*a* and 832*a* with different lengths. The protrusion 812*a* is formed such that it does not reach the same straight line of the y-axis direction formed by the protrusions 831*a* and 832*a*.

As described above, according to the plasma display panel of the present invention, electrodes are included between the rear substrate and the front substrate, the sustain electrodes are placed on both sides of one discharge cell, the scan electrode is placed between the sustain electrodes with the opposed discharge structure, and the phosphor layer is formed on the rear substrate and the front substrate, respectively. Accordingly, the discharge firing voltage can be reduced, and the sustain discharge is generated on both sides of one discharge cell to improve the luminous efficiency.

Furthermore, according to the plasma display panel of the present invention, the protrusions of the address electrodes are arranged on both sides with the scan electrode interposed therebetween in the opposed discharge structure, and thus the address discharge due to the short gap between the protrusions of the address electrode and the scan electrode can be induced and the address discharge voltage can be further reduced.

Moreover, according to the plasma display panel of the present invention, the protrusions of the scan electrode and the sustain electrode are included in the opposed discharge structure, and thus the discharge firing voltage is reduced by the short gap at the beginning of the discharge sustain period and the sustain discharge is induced by the long gap after the discharge is generated. Accordingly, the luminous efficiency is improved.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a first substrate and a second substrate which are opposite to and separated from each other at a predetermined interval and provided with a plurality of discharge cells defined in a space formed between the first substrate and the second substrate;

address electrodes which extend along a first direction in the space between the first substrate and the second substrate;

first electrodes formed on the first substrate that are arranged on both sides of each discharge cell along a second direction that crosses the first direction in the space between the first substrate and the second substrate and that are insulated from the address electrodes; and second electrodes that pass through each discharge cell and are arranged between and substantially parallel to the first electrodes, wherein the first electrodes and the second electrodes has an expansion portion which extends in a direction substantially perpendicular to a first substrate surface at a portion corresponding to each discharge cell and a narrow portion located at a portion corresponding to a boundary of a pair of discharge cells that are adjacent to each other in the second direction, and wherein the address electrodes have protrusions that protrude toward the inside of each discharge cell between the first electrodes and the second electrodes.

2. The plasma display panel of claim 1, wherein each of the address electrodes passes along a boundary of a pair of discharge cells that are adjacent to each other in the second direction.

3. The plasma display panel of claim 1, wherein each of the first electrodes passes along a boundary of a pair of discharge cells that are adjacent to each other in the first direction.

4. The plasma display panel of claim 1, wherein the first electrodes and the second electrodes each comprise a protrusion that protrudes toward a center of each discharge cell.

5. The plasma display panel of claim 1, wherein the first electrodes and the second electrodes are formed of metal.

6. The plasma display panel of claim 1, wherein, in the discharge cell, a distance between protrusions of the address electrodes and the second electrodes is less than a distance between the protrusions of the address electrodes and the first electrodes.

7. The plasma display panel of claim 1, wherein a distance between the protrusions of the address electrodes and a first substrate surface is approximately equal to a distance between the first electrodes or the second electrodes and the first substrate surface.

8. The plasma display panel of claim 1, wherein a thickness of the address electrodes in a direction substantially perpendicular to the first substrate is less than a thickness of the first electrodes in the direction substantially perpendicular to the first substrate.

9. The plasma display panel of claim 1, wherein a thickness of the address electrode in a direction substantially perpendicular to the first substrate is less than a thickness of the second electrodes in the direction substantially perpendicular to the first substrate.

10. The plasma display panel of claim 1, further comprising a dielectric layer formed on an outer surface of the first electrodes, the second electrodes, and the address electrodes.

11. The plasma display panel of claim 10, further comprising a protective film formed on an outer surface of the dielectric layer.

12. The plasma display panel of claim 1, further comprising a phosphor layer formed in each discharge cell and comprising:

a first phosphor layer formed on the first substrate of the discharge cell; and a second phosphor layer formed on the second substrate of the discharge cell and comprising a same color phosphor material as the first phosphor layer.

13. The plasma display panel of claim 12, wherein the first phosphor layer is thicker than the second phosphor layer.

14. The plasma display panel of claim 1, further comprising:

a black layer having a shape corresponding to a planar pattern of the address electrodes, the first electrodes, and the second electrodes, wherein the black layer is adjacent to the second substrate.

15. A plasma display panel, comprising:

a first substrate and a second substrate which are opposite to and separated from each other at a predetermined interval and provided with a plurality of discharge cells defined in a space formed between the first substrate and the second substrate;

a first barrier rib layer for defining a plurality of first discharge spaces on the first substrate comprises a plurality of first barrier rib members that extend in a first direction, a plurality of third barrier rib members crossing the first barrier rib members in a second direction and a plurality of fifth barrier rib members formed between the third barrier rib members that are adjacent and substantially parallel to each other in the second direction;

a second barrier rib layer for defining a plurality of second discharge spaces on the second substrate that face the first discharge spaces comprises a plurality of second barrier rib members that extend in the first direction, a plurality of fourth barrier rib members crossing the second barrier rib members in the second direction and a plurality of sixth barrier rib members formed between the fourth barrier rib members that are adjacent and substantially parallel to each other in the second direction, wherein each of the discharge cells is defined by a pair of opposing first and second discharge spaces and by the first, second, third and fourth barrier rib members;

address electrodes formed and extended along the first barrier rib members on the first barrier rib layer;

first electrodes formed and extended along the third barrier rib members on the first barrier rib layer and insulated from the address electrodes; and second electrodes formed and extended along the fifth barrier rib members on the first barrier rib layer, wherein the first electrodes and the second electrodes are arranged to oppose each other across the discharge cell and the first electrodes and the second electrodes each comprise protrusions that protrude toward the center of each discharge cell, wherein each of the first electrodes and the second electrodes has an expansion portion which extends in a direction substantially perpendicular to a first substrate surface at a portion corresponding to each discharge cell and a narrow portion located at a portion corresponding to a boundary of a pair of discharge cells that are adjacent to each other in the second direction, and wherein the address electrodes have protrusions that protrude toward the inside of each discharge cell between the first electrodes and the second electrodes.

16. The plasma display panel of claim 15, wherein the first electrodes and the second electrodes are formed of metal.

17. The plasma display panel of claim 15, wherein, in the discharge cell, a distance between protrusions of the address electrodes and the second electrodes is less than a distance between the protrusions of the address electrodes and the first electrodes.

18. The plasma display panel of claim 15, wherein a distance between the protrusions of the address electrodes and a first substrate surface is approximately equal to a distance between the first electrodes or the second electrodes and the first substrate surface.

19. The plasma display panel of claim 15, wherein a thickness of the address electrodes in a direction substantially perpendicular to the first substrate is less than a thickness of the first electrodes in the direction substantially perpendicular to the first substrate.

20. The plasma display panel of claim 15, wherein a thickness of the address electrode in a direction substantially perpendicular to the first substrate is less than a thickness of the second electrodes in the direction substantially perpendicular to the first substrate.

21. The plasma display panel of claim 15, wherein an area of each of the second discharge spaces formed by the second barrier rib layer is larger than an area of each of the first discharge spaces formed by the first barrier rib layer.

22. The plasma display panel of claim 15, further comprising a dielectric layer formed on an outer surface of the first electrodes, the second electrodes, and the address electrodes.

23. The plasma display panel of claim 22, further comprising a protective film formed on an outer surface of the dielectric layer.

24. The plasma display panel of claim 15, further comprising a phosphor layer formed in each discharge cell and comprising:

a first phosphor layer formed on the first substrate of the discharge cell; and a second phosphor layer formed on the second substrate of the discharge cell and comprising a same color phosphor material as the first phosphor layer.

25. The plasma display panel of claim 24, wherein the first phosphor layer is thicker than the second phosphor layer.

26. The plasma display panel of claim 15, further comprising:

a black layer having a shape corresponding to a planar pattern of the address electrodes, the first electrodes, and the second electrodes, wherein the black layer is adjacent to the second substrate.

27. A plasma display panel, comprising:

a first substrate and a second substrate which are opposite to and separated from each other at a predetermined interval and provided with a plurality of discharge cells defined in a space formed between the first substrate and the second substrate;

address electrodes which extend along a first direction in the space between the first substrate and the second substrate;

first electrodes formed on the first substrate that are arranged on both sides of each discharge cell along a second direction that crosses the first direction in the space between the first substrate and the second substrate and that are insulated from the address electrodes; and second electrodes that pass through each discharge cell and are arranged between and substantially parallel to the first electrodes, wherein the first electrodes and the second electrodes are arranged to oppose each other across the discharge cell, wherein each of the first electrodes and the second electrodes has an expansion portion which extends in a direction substantially perpendicular to a first substrate surface at a portion corresponding to each discharge cell and a narrow portion located at a portion corresponding to a boundary of a pair of discharge cells that are adjacent to each other in the second direction, wherein the address electrodes have protrusions that protrude toward the inside of each discharge cell between the first electrodes and the second electrodes, wherein one of a pair of first electrodes to which a sustain pulse is applied in a discharge sustain period is placed on one side of the discharge cell, the other of the pair of first electrodes is placed on another opposing side of the discharge cell, the second electrode to which a sustain pulse is applied in the discharge sustain period and a scan pulse is applied in an address period is placed between the first electrodes, and a sequence arranged in the first direction comprises the one of the pair of the first electrodes, the second electrode, and the other of the pair of first electrodes.

28. The plasma display panel of claim 27, wherein the protrusions of the address electrodes in a space formed between the one of the pair of first electrodes and the second electrode, and in a space between the second electrode and the other of the pair of first electrodes and wherein a sequence arranged in the first direction comprises the one of the pair of first electrodes, one or more of the protrusions of the address electrodes, the second electrode, another one or more of the protrusions of the address electrodes, and the other of the pair of first electrodes.

29. The plasma display panel of claim 27, wherein the sequence arranged in the first direction comprising the one of the pair of first electrodes, the second electrode, and the other of the pair of first electrodes is repeated and wherein both first electrodes of the pair of first electrodes are commonly connected or wherein even-numbered ones of the pair of first electrodes are commonly connected and odd-numbered ones of the pair of first electrodes are commonly connected.

* * * * *